US006140295A

United States Patent [19]

Behan et al.

[11] Patent Number: 6,140,295

[45] Date of Patent: Oct. 31, 2000

[54] PERFUMED LAUNDRY DETERGENTS CONTAINING LIPASE

[75] Inventors: John Martin Behan; Keith Douglas Perring, both of Ashford, United Kingdom; Brian James Willis, Laren, Netherlands

[73] Assignee: Unilever Patent Holdings B.V., Rotterdam, Netherlands

[21] Appl. No.: 08/205,767

[22] Filed: Mar. 4, 1994

Related U.S. Application Data

[63] Continuation of application No. 07/928,079, Aug. 13, 1992, abandoned, which is a continuation of application No. 07/591,093, Oct. 1, 1990, abandoned.

[30] Foreign Application Priority Data

Sep. 29, 1989 [GB] United Kingdom ..... 8921995

[51] Int. Cl.[7] ..... C11D 3/386

[52] U.S. Cl. ..... 510/320; 510/101; 510/102; 510/103; 510/104; 510/105; 510/106; 510/107; 510/382; 510/393; 510/530

[58] Field of Search ..... 510/101–107, 510/320, 392, 393, 530

[56] References Cited

U.S. PATENT DOCUMENTS

| | | | |
|---|---|---|---|
| 4,289,641 | 9/1981 | Hooper et al. | 252/96 |
| 4,304,679 | 12/1981 | Hooper et al. | 252/106 |
| 4,322,308 | 3/1982 | Hooper et al. | 252/107 |
| 4,514,705 | 4/1985 | Harzer . | |
| 4,663,068 | 5/1987 | Hagemann et al. | 252/99 |
| 4,923,631 | 5/1990 | Sims et al. | 252/42 |

FOREIGN PATENT DOCUMENTS

| | | |
|---|---|---|
| 142886 | 5/1985 | European Pat. Off. . |
| 0-271154 | 6/1988 | European Pat. Off. . |
| 325457 | 7/1989 | European Pat. Off. . |
| 332259 | 9/1989 | European Pat. Off. . |
| 0581751 | 4/1993 | European Pat. Off. . |
| 0579295 | 1/1994 | European Pat. Off. . |
| 0664335 | 7/1995 | European Pat. Off. . |
| 0430315 | 3/1997 | European Pat. Off. . |
| 60-23498 | 2/1985 | Japan . |
| 62-68898 | 3/1987 | Japan . |
| 2-178397 | 7/1990 | Japan . |

OTHER PUBLICATIONS

Database WPIL Derwent Publications, London, Accession No. 90–256521 week 34. JP–A–2178397.

Chemical Abstracts vol. 110 No. 9, May 1, 1989, p. 126. Abstract No. 156577u. JP–A–63275697.

Database WPIL Derwent Publications, London, Accession No. 85–070602 week 12. JP60023498.

Beyer H. et al, Lehrbuch der Organischen Chemie, S. Hirzel Verlag Stuttgart, pp. 458–468.

The Research Disclosure No. 26554 (see item 2.7 p. 3 of the European Search Report).

Japanese Abstract Patent No. 88–0290056 dated Jul. 14, 1995.

Product Range, Detergent Enzymes, Novo Nordisk, Detergent Enzyme Divison, Bioindustrial Group Division, Denmark, Feb. 1992, pp. 1–3.

*Primary Examiner*—Kery Fries

*Attorney, Agent, or Firm*—Pillsbury, Madison & Sutro LLP

[57] ABSTRACT

The invention relates to laundry detergents containing lipase and new perfumes and to the new perfumes themselves. Such new perfumes counteract residual malodors of lipase treated laundry. They comprise at least 25% by weight of one or more fragrance materials chosen from: aliphatic ketones with m(olecular) w(eight) between 200 and 350 A(tomic) M(ass) U(nits), aromatic ketones with mw between 150 and 350 AMU, aliphatic aldehydes with mw between 160 and 350 AMU, aromatic aldehydes with mw between 130 and 350 AMU, nitriles with mw between 150 and 350 AMU, condensation products of aldehydes and amines with mw between 190 and 350 AMU, macrocyclic lactones with mw below 350 AMU and aromatic nitromusks, and less than 50% by weight of esters from fatty acids with 1–7 carbon atoms. Preferably they contain more than 30% of the specified fragrance materials and less than 30% of the esters.

9 Claims, No Drawings

PERFUMED LAUNDRY DETERGENTS CONTAINING LIPASE

This application is a continuation of Ser. No. 07/928,079 filed Aug. 13, 1992 which is a continuation of Ser. No. 07/591,093 filed Oct. 11, 1990, both abandoned.

The invention relates to perfumed laundry detergents. More specifically it relates to perfumed laundry detergents containing a lipase. The invention also relates to perfumes suitable for addition to laundry detergents containing lipase.

It is generally known to add enzymes to laundry detergents to aid in the removal of different kinds of stains. Many types of enzymes have been proposed for inclusion in laundry detergents, but the emphasis has been on proteases and amylases. The use of lipases in laundry detergents has been described in the patent literature e.g. in GB 1,372,034, U.S. Pat. Nos. 3,950,277, 4,011,169, 4,707,291, EP 205,208, EP 206,390, EP 268,456, and JP-A-63/078000 as well as in Research Disclosure 29056 of June 1988 and documents cited therein. However up to now lipases have found only limited use in laundry detergents.

It is also known in the art that enzymes are seldom completely specific in their activity, and commercial enzymes are seldom totally pure. Thus, virtually all proteases have some lipase/esterase activity.

Lipases are of great potential benefit in laundry detergents since such detergents are more able to deal with greasy soils on cloth by hydrolysis of the fat therein. However, such laundry detergents may sometimes leave residual odours attached to the cloth. This problem is not alleviated by the use of "odour-purified" lipases ("odour-purified" defined as per test method of EP 142 886, described for proteases). Thus, these odours do not seem to be associated with the odour of the enzyme itself. Such residual malodours detract from the overall performance of the detergent as perceived by the customer. It has been experienced that this malodour effect cannot be overcome simply by adding traditional perfumes to the detergent; some perfumes are found to make the situation even worse.

It has now been found that perfumes containing at least a certain minimum quantity of fragrance materials, chosen from certain groups and not more than a certain maximum quantity of fragrance materials belonging to another group are able to counteract the problem of the residual malodour of lipase treated laundry. Therefore on the one hand the invention presents new perfumes for lipase-containing laundry detergents and on the other hand the invention presents new laundry detergents containing lipase and special perfumes; such perfumes comprising:

a) at least 25% by weight of one or more fragrance materials chosen from:
   - aliphatic ketones with a molecular weight of between 200 and 350 A(tomic) M(ass) U(nits),
   - aromatic ketones with a molecular weight of between 150 and 350 AMU,
   - aliphatic aldehydes with a molecular weight of between 160 and 350 AMU,
   - aromatic aldehydes with a molecular weight of between 130 and 350 AMU,
   - nitriles with a molecular weight of between 150 and 350 AMU,
   - condensation products of aldehydes with amines with a total molecular weight of between 190 and 350 AMU,
   - macrocyclic lactone musks with a molecular weight below 350 AMU;
   - aromatic nitromusks b) less than 50% by weight of esters derived from fatty acids with 1–7 carbon atoms.

Preferred are perfumes and laundry detergents containing such perfumes wherein the proportion of fragrance materials chosen from the groups specified above under a) in the perfume is at least 30% and particularly preferred are perfumes and perfumed products wherein this proportion is at least 40%. Likewise preferred are perfumes and perfumed detergents wherein the perfume contains less than 30%, particularly less than 20% by weight of esters from fatty acids with 1–7 carbon atoms.

Suitable aliphatic ketones are e.g.:
- 2,7,8,-trimethyl-1-acetyl-cyclododeca-2,5,7-triene
- 7-acetyl-1,1,6,7-tetramethyl-1,2,3,4,5,6,7,8-octahydronaphthalene
- isolongifolanone
- gamma-irone
- alpha-vetivone Suitable aromatic ketones are e.g.:
- 4-(p-hydroxyphenyl)-butan-2-one
- 1,1,2,4,4,7-hexamethyl-6-acetyl-tetralin
- benzophenone
- methyl naphthyl ketone Suitable aliphatic aldehydes are e.g.:
- 2-methylhendecanal
- undecanal
- 4-(4'-methyl-4'-hydroxypentyl)-cyclohex-3-ene carbaldehyde
- 7-formyl-5-isopropyl-2-methyl-bicyclo[2.2.2]oct-2-ene
- 4-(tricyclo[5.2.1.0{2,6}]decylidene-8)-butanal
- 4-(4'-methylpent-3-enyl)-cyclohex-3-ene carbaldehyde Suitable aromatic aldehydes are e.g.:
- alpha-hexylcinnamic aldehyde
- anisic aldehyde
- heliotropin
- 2-phenylpropanal
- dihydrocinnamic aldehyde
- 3-(p-tert.butylphenyl)-2-methylpropanal Suitable nitriles are e.g.:
- 2-methyldecanonitrile
- tridecene-2-nitrile
- geranonitrile
- cinnamonitrile
- citronellonitrile
- dodecanonitrile Suitable condensation products of aldehydes and amines are e.g.
- methyl N-(2,4-dimethyl-3-cyclohexenyl)methylidene-anthranilate
- methyl N-(3,7-dimethyl-7-hydroxy-octylidene)-anthranilate
- methyl N-[4-(4'-methyl-4'-hydroxypentyl)-cyclohex-3-enyl]methylideneanthranilate Suitable macrocyclic lactone musks are e.g.:
- ethylene dodecanedioate
- 1-oxahexadecanolide
- cyclopentadecanolide Suitable aromatic nitromusks are e.g.:
- musk xylene Laundry detergents according to the invention may be powdered or granular solids, bars, pastes or liquids, either aqueous or non-aqueous. Apart from lipase they may contain ingredients usual in the art e.g. anionic, cationic, zwitterionic or nonionic detergent active compounds, builders, sequestrants, inorganic fillers, bleaching agents, optical brighteners, antiredeposition agents, fabric conditioning agents, other enzymes and the like. Such laundry detergents may further contain other conventional ingredients such as described in the literature cited above. Thus, a typical laundry detergent comprises: 5–40% anionic detergent active, 1–20% non-ionic detergent active, 0–5% lather booster, 0–30% builders/sequestrants, 0–60% inorganic fillers, 0–15% bleaching agent, up to 15% of one or more of optical brighteners, antiredeposition agents, enzymes and fabric conditioning agents and 0.05–1.5% of perfume.

Suitable lipases for inclusion in laundry detergents according to the invention are e.g. Lipozyme, Lipolase SP-285, SP-356 and SP-400 of Novo Industri A/S, Denmark, Amano lipases P, B, CES, CE, AP, M-AP, and AML of Amano Pharmaceutical Co., Japan, Meito lipases MY-30, OF and PL, Saiken lipase and Enzeco lipase (trade names). Other suitable lipases are disclosed in the literature cited above, particularly in Research Disclosure 29056 and literature cited therein. Lipases may be added in admixture with other enzymes. Alternatively enzymes may be used which although primarily characterized by other activity, also exhibit useful lipase activity The quantity of lipase in the laundry detergent is preferably such as to produce a lipolytic enzyme activity of at least 20 LU/g, particularly 100 LU/g or more, most suitably at least 500 LU/g.

A Lipase Unit (LU) is the amount of lipase which produces 1 $\mu$mol of titratable fatty acid per minute in a pH stat. at a temperature of 30° C. and pH=9.0, from an emulsion of 3.3 wt % olive oil and 3.3% gum arabic, in the presence of 13 mmol $Ca^{2+}$ and 20 mmol NaCl in 5 mmol Tris-buffer.

The following examples illustrate the invention, but the invention is not in any way limited thereto.

EXAMPLE 1

Fragrance materials were tested on their ability to counteract residual malodour on cloth washed in lipase containing laundry detergent.

Soiling

A standard soiling method was used as described below: 10 g of dairy product (preferably milk) was applied evenly over squares of acrylic cloth of 1600 $cm^2$. The cloths were then sealed in plastic bags for 1 hour. Thereafter, the cloths were line dried overnight.

Wash procedure 6 g laundry powder (composition: see below) containing 0.5% Lipolase 100T ex Novo Industri A/S and 0.1% of the fragrance material to be tested, 1 l of water at 40° C. and a soiled cloth prepared as described above were loaded into a Terg-O-tometer. The cloths were washed for 10 minutes at 150 rpm. After wringing out, the cloths were line dried for 24 hours. The dried cloths were placed into plastic bags and left to equilibrate for 1 hour at room temperature. Control samples of cloth, washed in unperfumed laundry powder, were prepared in the same way.

| Laundry powder composition: | percent w/w |
|---|---|
| Sodium alkylaryl sulphonate | 9.9 |
| Non-ionic surfactant | 2.9 |
| Sodium soap | 1.1 |

-continued

| Laundry powder composition: | percent w/w |
|---|---|
| Zeolite (4A type) | 27.6 |
| Sodium carbonate | 12.0 |
| Sodium sulphate | 28.0 |
| Sodium silicate | 1.5 |
| Anti-redeposition agent | 0.8 |
| Sodium EDTA | 0.3 |
| Lipase (as specified above) | 0.5 |
| Fragrance material (as specified above) | 0.1 |
| Bleaching agents (Sodium perborate / EDTA) | 6.8 |
| Miscellaneous (water, dyes, etc) | 8.5 |

Sensory analysis

The perceived intensity of residual malodour was assessed on the cloths by a panel of 30 individuals, trained to use magnitude estimation. The data were normalised using internal standards and averaged to give a consensus value for the perceived intensity of residual malodour for each fragrance material. These perceived intensities are expressed in arbitrary units, which cannot be interpreted as absolute values of intensity, but are indicative of the ratio of perceived intensities of malodour for the tested fragrance materials.

Perfumers' experience taught that compounds with perceived residual malodour intensities above 63 did not sufficiently counteract residual malodours to be effectively used in a perfume for a lipase-containing laundry detergent.

Results

| | Perceived malodour intensity |
|---|---|
| Aliphatic ketones with MW ≧ 200: | |
| 2,7,8,-trimethyl-1-acetyl-cyclododeca-2,5,7--triene | 15 |
| 7-acetyl-1,1,6,7-tetramethyl-1,2,3,4,5,6,7,8--octahydronaphthalene | 56 |
| isolongifolanone | 56 |
| Aliphatic ketones with MW < 200: | |
| ionone | 81 |
| 2-n-heptylcyclopentanone | 99 |
| Aromatic ketones with MW ≧ 150: | |
| 4-(p-hydroxyphenyl)-butan-2-one | 33 |
| 1,1,2,4,4,7-hexamethyl-6-acetyl-tetralin | 50 |
| Aliphatic aldehydes with MW ≧ 160: | |
| 4-(4'-methyl-4'-hydroxypentyl)-cyclohex-3-ene carbaldehyde | 33 |
| 7-formyl-5-isopropyl-2-methyl-bicyclo[2.2.2]-oct-2-ene | 42 |
| 4-(tricyclo[5.2.1.0{2,6}]decylidene-8)-butanal | 50 |
| Aromatic aldehydes with MW ≧ 130: | |
| alpha-hexylcinnamic aldehyde | 54 |
| anisic aldehyde | 54 |
| heliotropin | 49 |
| 3-(p-tert.butylphenyl)-2-methylpropanal | 44 |
| Nitriles with MW ≧ 150: | |
| tridecene-2-nitrile | 45 |
| citronellonitrile | 50 |
| Condensation compounds of aldehydes and amines with MW ≧ 190: | |
| methyl N-(2,4-dimethyl-3-cyclohexenyl)-methylidene-anthranilate | 38 |
| methyl N-(3,7-dimethyl-7-hydroxyoctylidene) | 49 |

-continued

| | Perceived malodour intensity |
|---|---|
| -anthranilate | |
| Macrocyclic lactones: | |
| 11-oxahexadecanolide | 17 |
| cyclopentadecanolide | 36 |
| Aromatic nitromusks: | |
| musk xylene | 40 |
| Esters from fatty acids with 1–7 carbon atoms: | |
| 2-tert.butylcyclohexyl acetate | 72 |
| hexahydro-4,7-methanoinden-5(or 6)-yl propionate | 84 |
| Hexahydro-4,7-methanoinden-5(or 6)-yl acetate | 114 |
| 1,3-nonanediol diacetate | 71 |

EXAMPLE 2

Three perfumes for incorporation into a lipase containing laundry detergent were prepared according to the recipes A, B and C (* indicates effective malodour counteracting fragrance materials), and tested on soiled cloths for their malodour reducing capabilities according to the procedure described in EXAMPLE 1, except that the laundry powder composition contained 0.3% of the perfume instead of 0.1% of a fragrance material. The washed cloths were sensory analysed in comparison with cloth washed in unperfumed laundry powder again as described above. The results of the sensory analysis were normalised using standard statistical procedures to give a consensus value of residual perceived malodour as a percentage of the original malodour.

Perfumers' experience taught that perfumes with a residual perceived malodour intensity of more than 50% do not sufficiently counteract residual malodours to be practically useful in a perfume for a lipase-containing laundry detergent.

| | parts by weight |
|---|---|
| Perfume A | |
| Benzyl salicylate | 25 |
| P-tert.butylcyclohexyl acetate | 15 |
| Alpha-hexylcinnamic aldehyde | 15* |
| Benzyl acetate | 10 |
| 4-Acetoxy-3-pentyltetrahydropyran | 8 |
| Amyl salicylate | 7 |
| Citronellol | 7 |
| Tetrahydrolinalool | 5 |
| Alpha-amylcinnamic aldehyde | 5* |
| 7-Acetyl-1,1,6,7-tetramethyl-1,2,3,4,5,6,7,8- -octahydronaphtalene | 3* |
| Total | 100 |
| Residual perceived malodour intensity: 51% | |
| Perfume B | |
| Benzyl salicylate | 20 |
| Alpha-hexylcinnamic aldehyde | 20* |
| P-tert.butylcyclohexyl acetate | 15 |
| 1,3,4,6,7,8-Hexahydro-4,6,6,7,8,8-hexamethyl- -cyclopenta(g)-2-benzopyran | 10 |
| 1,1,2,4,4,7-Hexamethyl-6-acetyl-tetralin | 8* |
| 2-Phenylethanol | 5 |
| Benzyl acetate | 5 |
| Coumarin | 4 |
| Geraniol | 4 |

-continued

| | parts by weight |
|---|---|
| Tetrahydrolinalool | 4 |
| Methyl N-(2,4-dimethyl-3-cyclohexenyl)- -methylideneanthranilate | 3* |
| 4-(p-hydroxyphenyl)-butan-2-one | 2* |
| Total | 100 |
| Residual perceived malodour intensity: 28% | |
| Perfume C | |
| Benzyl salicylate | 20 |
| Alpha-hexylcinnamic aldehyde | 15* |
| P-tert.butylcyclohexyl acetate | 15 |
| 1,1,2,4,4,7-Hexamethyl-6-acetyl-tetralin | 12* |
| 1,3,4,6,7,8-Hexahydro-4,6,6,7,8,8-hexamethyl- -cyclopenta(g)-2-benzopyran | 8.5 |
| Benzyl acetate | 5 |
| 3-(p-tert.butylphenyl)-2-methylpropanal | 4.5* |
| Patchouli, acid washed | 4.5 |
| 2,7,8-trimethyl-1-acetyl-cyclododeca-2,5,9-triene | 4* |
| 4-(p-hydroxyphenyl)-butan-2-one | 4* |
| Methyl naphthyl ketone | 2.5* |
| Methyl N-(3,7-dimethyl-7-hydroxyoctylidene)- -anthranilate | 2* |
| Oakmoss synthetic | 2 |
| Karanal (tradename of Quest International) | 1 |
| Total | 100 |
| Residual perceived malodour intensity: 14% | |

EXAMPLE 3

A perfume for laundry detergents, actively counteracting residual malodours, was prepared according to the following recipe (malodour counteracting components are marked with *):

| | |
|---|---|
| Benzyl salicylate | 19.7 |
| Alpha-hexylcinnamic aldehyde | 16.0* |
| O-tert.butylcyclohexyl acetate | 14.0 |
| 1,1,2,4,4,7-Hexamethyl-6-acetyl-tetralin | 12.0* |
| 1,3,4,6,7,8-Hexahydro-4,6,6,7,8,8-hexamethyl- -cyclopenta(g)-2-benzopyran | 9.5 |
| Benzyl acetate | 5.0 |
| 3-(p-tert.butylphenyl)-2-methylpropanal | 4.5* |
| 2,7,8-trimethyl-1-acetyl-cyclododeca-2,5,9-triene | 4.0* |
| 4-(p-hydroxyphenyl)-butan-2-one | 4.0* |
| Musk xylene | 3.5* |
| Patchouli, acid washed | 3.3 |
| methyl N-[3-(4'-methyl-4'-hydroxypentyl)- cyclohex-3-enyl]methylideneanthranilate | 2.0* |
| Oakmoss synthetic | 1.5 |
| 11-Oxahexadecanolide | 1.0* |
| Total | 100 |

What is claimed is:

1. In a perfumed laundry detergent containing lipase in an amount effective to produce a lipolytic enzyme activity of at least 20 LU/g, the improvement wherein the detergent includes from 0.05 to 1.5% by weight, based on the weight of the detergent, of a perfume which comprises a mixture of fragrance materials:

a) at least 40% by weight of said perfume being one or more fragrance materials chosen from the groups of:
   - aliphatic ketones with a molecular weight of between 200 and 350 AMU,
   - aromatic ketones with a molecular weight of between 150 and 350 AMU,
   - aliphatic aldehydes with a molecular weight of between 160 and 350 AMU, aromatic aldehydes with a molecular weight of between 130 and 350 AMU, nitrites with a molecular weight of between 150 and 350 AMU, condensation products of aldehydes and amines with a molecular weight of between 150 and 350, macrocyclic lactone musks; and b) less than 50% by weight of said perfume being esters derived from fatty acids with 1–7 carbon atoms, said mixture including components (a) and (b) functioning to avoid malodor in lipase-treated laundry.

2. Laundry detergent according to claim 1 wherein the proportion of esters derived from fatty acids with 1–7 carbon atoms is less than 30% of the perfume.

3. Laundry detergent according to claim 1 wherein the lipase content is such as to produce a lipolytic enzyme activity of at least 100 LU/g.

4. Perfume suitable for addition to lipase containing laundry detergents, for the purpose of reducing malodors to laundry treated therewith, said perfume comprising a mixture of a plurality of fragrance materials wherein:

a) at least 40% by weight of the perfume is a plurality of fragrance materials chosen from the groups of:

aliphatic ketones with a molecular weight of between 200 and 350 AMU, aromatic ketones with a molecular weight of between 150 and 350 AMU, aliphatic aldehydes with a molecular weight of between 160 and 350 AMU, aromatic aldehydes with a molecular weight of between 130 and 350 AMU, nitrites with a molecular weight of between 150 and 350 AMU, condensation products of aldehydes and amines with a molecular weight of between 150 and 350, macrocyclic lactone musks; and b) less than 50% by weight, of said perfume is esters derived from fatty acids with 1–7 carbon atoms, said mixture including components (a) and (b) functioning to avoid malodor in lipase-treated laundry.

5. Perfume according to claim 4 wherein the proportion of esters derived from fatty acids with 1–7 carbon atoms is less than 30% by weight of the perfume.

6. In a perfumed laundry detergent containing lipase in an amount effective to produce a lipolytic enzyme activity of at least 100 LU/g, the improvement wherein the detergent includes from 0.05 to 1.5% by weight, based on the weight of the detergent, of a perfume which comprises a mixture of fragrance materials:

a) at least 25% by weight of said perfume being one or more materials chosen from the groups of:

aliphatic ketones with a molecular weight of between 200 and 350 AMU, aromatic ketones with a molecular weight of between 150 and 350 AMU, aliphatic aldehydes with a molecular weight of between 160 and 350 AMU, aromatic aldehydes with a molecular weight of between 130 and 350 AMU, nitrites with a molecular weight of between 150 and 350 AMU, condensation products of aldehydes and amines with a molecular weight of between 190 and 350, macrocyclic lactone musks;

aromatic nitromusks; and b) less than 50% by weight of said perfume being esters derived from fatty acids with 1–7 carbon atoms, said mixture including components (a) and (b) functioning to avoid malodor in lipase-treated laundry.

7. Laundry detergent according to claim 6 wherein the proportion of fragrance materials chosen from the groups specified under (a) is at least 30% by weight of the perfume.

8. Laundry detergent according to claim 6 wherein the proportion of fragrance materials chosen from the groups specified under (a) is at least 40% by weight of the perfume.

9. Laundry detergent according to claim 6 wherein the proportion of esters derived from fatty acids with 1–7 carbon atoms is less than 30% of the perfume.

* * * * *